US011268167B2

(12) United States Patent
Hung et al.

(10) Patent No.: US 11,268,167 B2
(45) Date of Patent: Mar. 8, 2022

(54) STIRRING DEVICE HAVING DEGASSING AND FEEDING FUNCTIONS

(71) Applicant: METAL INDUSTRIES RESEARCH AND DEVELOPMENT CENTRE, Kaohsiung (TW)

(72) Inventors: Pei-Chun Hung, Kaohsiung (TW); Shin-Hong Kuo, Kaohsiung (TW)

(73) Assignee: METAL INDUSTRIES RESEARCH AND DEVELOPMENT CENTRE, Kaohsiung (TW)

( * ) Notice: Subject to any disclaimer, the term of this patent is extended or adjusted under 35 U.S.C. 154(b) by 88 days.

(21) Appl. No.: 16/719,272

(22) Filed: Dec. 18, 2019

(65) Prior Publication Data

US 2021/0189522 A1 Jun. 24, 2021

(51) Int. Cl.

| | |
|---|---|
| ***C22C 1/02*** | (2006.01) |
| ***B22D 1/00*** | (2006.01) |
| ***C22C 49/14*** | (2006.01) |

(52) U.S. Cl.

CPC ..... *C22C 1/026* (2013.01); *B22D 1/00* (2013.01); *C22C 49/14* (2013.01)

(58) Field of Classification Search

CPC ..... C22C 1/026; C22C 49/14; B22D 1/00; F27D 27/00; C22B 9/05; C22B 21/064; C21C 7/072

USPC ..... 266/233, 235, 239, 217, 216; 75/684, 75/685, 708; 366/169.1, 175.2

See application file for complete search history.

(56) References Cited

U.S. PATENT DOCUMENTS

| | | | | |
|---|---|---|---|---|
| 4,040,610 | A * | 8/1977 | Szekely | C22B 21/064 266/235 |
| 5,413,315 | A * | 5/1995 | Venas | C22B 21/064 266/222 |
| 5,846,481 | A * | 12/1998 | Tilak | C22B 21/064 266/217 |
| 6,106,588 | A * | 8/2000 | Skibo | C22B 9/103 266/216 |
| 6,375,712 | B1 * | 4/2002 | Forberg | C22B 9/05 75/680 |

(Continued)

FOREIGN PATENT DOCUMENTS

| | | | | |
|---|---|---|---|---|
| CN | 107385263 | * | 11/2017 | B22D 1/00 |
| CN | 107385263 | A | 11/2017 | |

OTHER PUBLICATIONS

Search Report appended to an Office Action, which was issued to Taiwanese counterpart Application No. 108142372 by the TIPO dated Nov. 24, 2020 with an English translation thereof.

*Primary Examiner* — Scott R Kastler
*Assistant Examiner* — Michael Aboagye
(74) *Attorney, Agent, or Firm* — Muncy, Geissler, Olds & Lowe, P.C.

(57) ABSTRACT

A stirring device includes a stirring unit, a gas supplying unit, and a feeding unit. The stirring unit includes a drive mechanism and a shaft member. The shaft member includes a hollow rotary shaft coupled to be driven by the drive mechanism to rotate, and a stirring head coupled to rotate with the hollow rotary shaft. The gas supplying unit includes a gas supply, and a piping member fluidly communicating with the gas supply and the shaft member. The feeding unit includes a storage tank and a feeding tube fluidly communicating with the storage tank and the shaft member.

9 Claims, 3 Drawing Sheets

(56) References Cited

U.S. PATENT DOCUMENTS 6,547,850 B1 * 4/2003 Skibo ..... B01F 3/1221
266/235

* cited by examiner

STIRRING DEVICE HAVING DEGASSING AND FEEDING FUNCTIONS

FIELD

The disclosure relates to a stirring device, and more particularly to a stirring device having degassing and feeding functions.

BACKGROUND

Stir-melting is a process for melting an alloy, and has been developed into various stirring mechanisms, such as stir-casting, in-situ synthesis, squeeze-casting, cast-forging, semi-solid casting, etc.

Referring to FIG. 1, a conventional stirring device 1 for stir-melting includes a furnace 11 for containing a metal melt 2, a rotary motor 14 disposed above the furnace 11, a rotatable shaft 12 that is coupled to be driven by the rotary motor 14 to rotate and that extends axially into the furnace 11, and a stirring head 13 coupled to rotate with the rotatable shaft 12 so as to stir the metal melt 2 in the furnace 11.

The stirring device 1 can be used to mix reinforcing particles (e.g., silicon carbide particles) with an aluminum matrix for preparing an aluminum-based composite, which is widely applied in precision machinery due to its superior thermal conductive properties and being lighweight. When the stirring device 1 is used for preparing the aluminum-based composite, the reinforcing particles are added onto a surface of the aluminum matrix in the furnace 11. However, a layer of oxide (i.e., aluminum oxide) formed on the surface of the aluminum matrix might also be carried into the aluminum matrix as the reinforcing particles on the surface of the aluminum matrix are being drawn into the aluminum matrix, causing the oxide to surround the reinforcing particles and thus inhibit the ability of the aluminum matrix to wet the reinforcing particles, thereby prolonging the time period for mixing the reinforcing particles and the aluminum matrix. In addition, agglomerates of the reinforcing particles might produce defects, such as formation of microporosity in the aluminum-based composite and uneven distribution of the reinforcing particles in the aluminum matrix. Furthermore, the surface tension on the aluminum matrix might hinder the reinforcing particles that are relatively lightweight from entering into the aluminum matrix, which might cause the reinforcing particles to spill out of the furnace 11. Therefore, adding the reinforcing particles into the conventional stirring device 1 might even cause industrial accidents to the operator.

SUMMARY

An object of the disclosure is to provide a stirring device having degassing and feeding functions so as to overcome the shortcomings described above.

According to the disclosure, there is provided a stirring device which has degassing and feeding functions, and which is adapted to be installed in a furnace that contains a metal melt. The stirring device includes a stirring unit, a gas supplying unit, and a feeding unit.

The stirring unit includes a drive mechanism and a shaft member. The shaft member extends axially into the furnace, and includes a hollow rotary shaft coupled to be driven by the drive mechanism to rotate and a stirring head coupled to rotate with the hollow rotary shaft.

The gas supplying unit includes a gas supply and a piping member fluidly communicating with the gas supply and the shaft member.

The feeding unit includes a storage tank and a feeding tube fluidly communicating with the storage tank and the shaft member.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
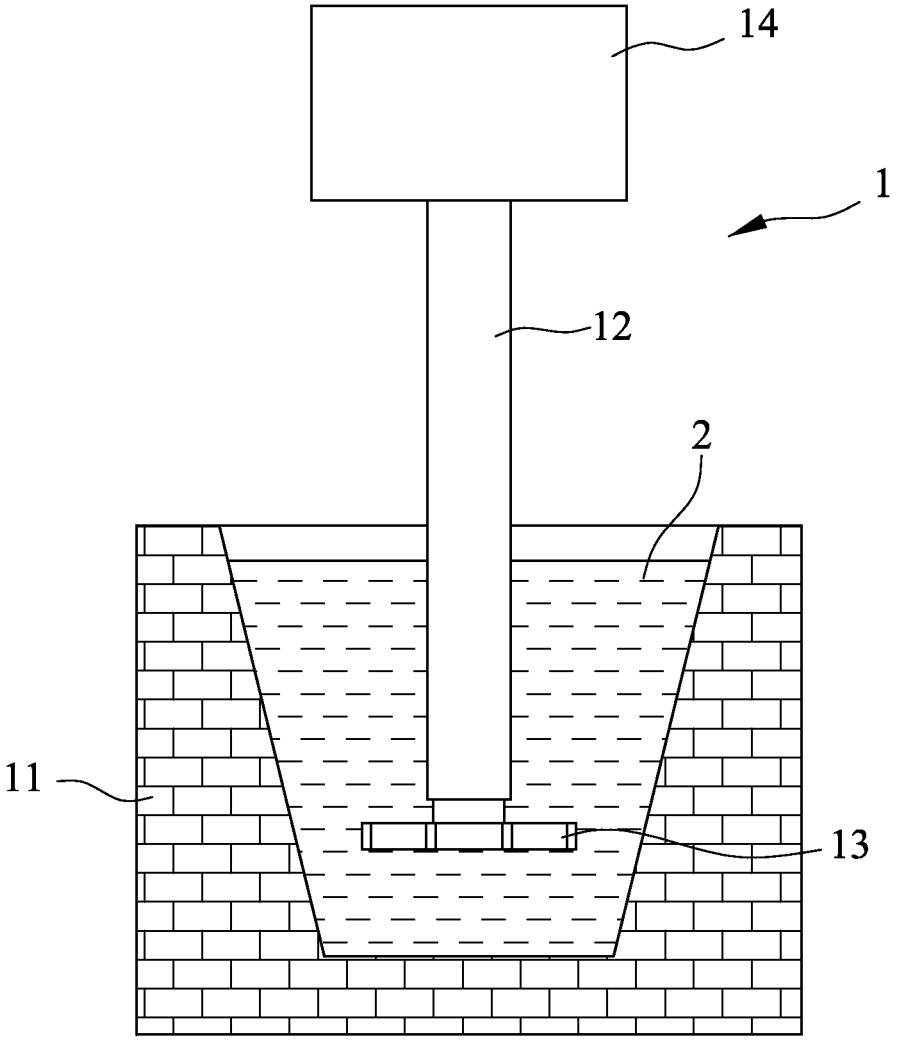
FIG.1 PRIOR ART
FIG. 1 is a schematic view of a conventional stirring device.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
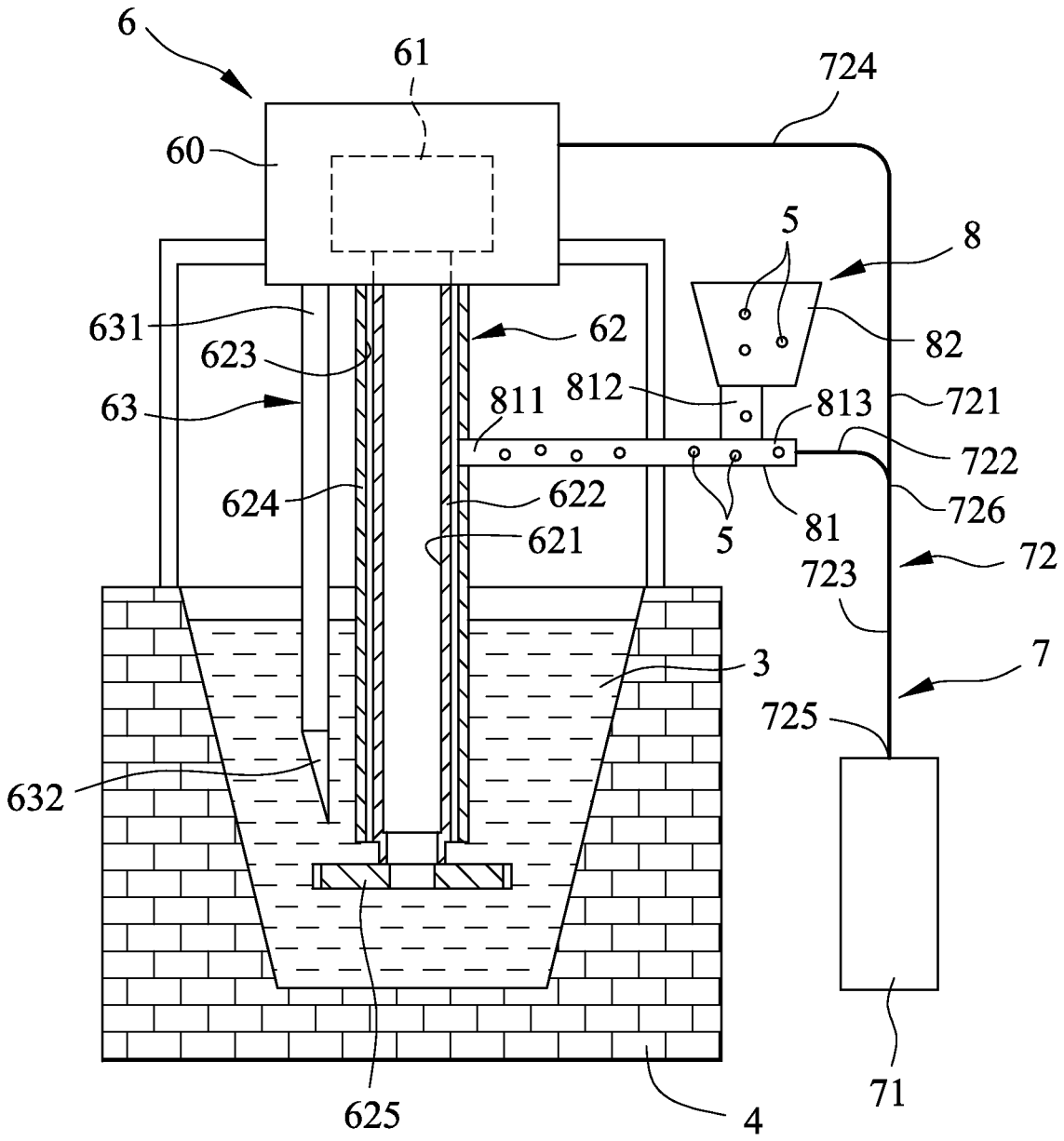
FIG. 2 is a schematic view of a first embodiment of a stirring device according to the disclosure.

Referring to FIG. 2, a first embodiment of a stirring device according to the disclosure has degassing and feeding functions, and is installed in a furnace 4 that contains a metal melt 3. The stirring device can be used in a stir-melting process for adding and mixing an additive material 5 (for example, but not limited to, silicon carbide particles) into the metal melt 3 (for example, but not limited to, an aluminum matrix) in the furnace 4. The surface of the aluminum matrix is liable to atmospheric oxidation. The stirring device includes a stirring unit 6, a gas supplying unit 7, and a feeding unit 8.

The stirring unit 6 includes a drive mechanism 60 and a shaft member 62.

The drive mechanism 60 is disposed above the furnace 4, and includes a rotary motor 61.

The shaft member 62 may be made from, for example, but not limited to, graphite which is inert to the aluminum matrix. The shaft member 62 extends axially into the furnace 4, and includes a hollow rotary shaft 622 and a stirring head 625. The hollow rotary shaft 622 is coupled to be driven by the drive mechanism 60 to rotate. Specifically, the hollow rotary shaft 622 is coupled to be driven by the rotary motor 61 to rotate. The stirring head 625 is coupled to rotate with the hollow rotary shaft 622 so as to stir the metal melt 3 in the furnace 4. The stirring head 625 may be made from, for example, graphite, and can be configured as, for example, a disk-shaped body formed with a plurality of toothed blocks projecting radially outward and angularly spaced apart from one another, but is not limited thereto.

The stirring unit 6 further includes a baffle 63 that is fixed to the drive mechanism 60, and that is spaced apart from the shaft member 62 and extends axially into the furnace 4. The baffle 63 is disposed so as to provide a shear region between the baffle 63 and the stirring head 625. The baffle 63 is made from, for example, but not limited to, graphite, and includes a main board portion 631 extending downwardly from the drive mechanism 60 into the furnace 4, and a wedge-shaped extending portion 632 extending downwardly and convergingly from the main board portion 631.

The gas supplying unit 7 includes a gas supply 71, and a piping member 72 fluidly communicating with the gas supply 71 and the shaft member 62.

The feeding unit 8 includes a storage tank 82, and a feeding tube 81 fluidly communicating with the storage tank 82 and the shaft member 62.

The gas supply 71 fluidly communicates with the hollow rotary shaft 622 of the shaft member 62 and the feeding tube 81, and is selectively controlled to supply inert gas into the hollow rotary shaft 622 and the feeding tube 81.

The gas supply 71 is disposed upstream of the shaft member 62 to supply the inert gas from the gas supply 71 into the metal melt 3 in the furnace 4 through the shaft member 62, and specifically through the hollow rotary shaft 622 of the shaft member 62.

The storage tank 82 is used for storing the additive material 5, and is coupled to the shaft member 62 to permit the additive material 5 to be transported from the storage tank 82 into the metal melt 3 in the furnace 4 through the shaft member 62, so as to mix the additive material 5 with the metal melt 3.

Specifically, in the first embodiment, the hollow rotary shaft 622 defines an inner passage 621 that fluidly communicates with the piping member 72, and is disposed to permit the inner gas to be transported from the gas supply 71 into the metal melt 3 in the furnace 4 through the inner passage 621.

The shaft member 62 further includes a sleeve 624 that is sleeved around and spaced apart from the hollow rotary shaft 622 to define an outer passage 623 between the sleeve 624 and the hollow rotary shaft 622, and that is fixed to the drive mechanism 60 to permit the hollow rotary shaft 622 to rotate relatively thereto. The outer passage 623 fluidly communicates with the feeding tube 81.

The storage tank 82 is coupled to the sleeve 624 so as to permit the additive material 5 to be transported into the metal melt 3 in the furnace 4 through the outer passage 623.

Specifically, the feeding tube 81 is configured to permit the storage tank 82 to be coupled to the sleeve 624 so as to permit the additive material 5 to be transported into the metal melt 3 in the furnace 4 through the feeding tube 81 and the outer passage 623. The feeding tube 81 has an outlet port 811 connected to the sleeve 624 for fluidly communicating with the outer passage 623, a first inlet port 812 for fluidly communicating with the storage tank 82, and a second inlet port 813.

The piping member 72 includes a first piping 721 fluidly communicating with the hollow rotary shaft 622, and a second piping 722 fluidly communicating with the feeding tube 81.

The first piping 721 includes an upstream pipe 723 and a downstream pipe 724. The upstream pipe 723 extends lengthwise to terminate at a first pipe end 725 that is connected to the gas supply 71, and a second pipe end 726. The downstream pipe 724 is disposed downstream of the second pipe end 726 of the upstream pipe 723 and, upstream of the inner passage 621 so as to permit the inner gas to be transported into the metal melt 3 in the furnace 4 through the upstream pipe 723, the downstream pipe 724, the driving mechanism 60, and the inner passage 621.

The second piping 722 is disposed downstream of the second pipe end 726 of the upstream pipe 723 to permit the inert gas to flow into the second piping 722 through the upstream pipe 723, and upstream of the second inlet port. 813 of the feeding tube 81 such that the additive material 5 is forced by the inert gas flowing into the second piping 722 to be transported into the metal melt 3 in the furnace 4 through the feeding tube 81 and the outer passage 623.

When the first embodiment of the stirring device according to the disclosure is operated, the hollow rotary shaft 622 is driven by the rotary motor 61 to rotate relatively to the sleeve 624, such that the stirring head 625 is permitted to rotate with the hollow rotary shaft 622 so as to stir the metal melt 3 (for example, an aluminum matrix in the furnace 4. The inert gas is then supplied from the gas supply 71 into the metal melt 3 in the furnace 4 through the upstream pipe 723, the downstream pipe 724, the driving mechanism 60, and the inner passage 621. Therefore, slag and gas can be effectively removed from the metal melt 3. In addition, the additive material 5 (for example, silicon carbide particles) from the storage tank 82 is forced by the inert gas flowing into the second piping 722 to be transported into the metal melt 3 in the furnace 4 through the feeding tube 81 and the outer passage 623, so as to mix the additive material 5 with the metal melt 3. Since the additive material 5 is transported into the metal melt 3 in the furnace 4, rather than onto the metal melt 3, the aforesaid shortcomings of the prior art can be overcome.

It should be noted that the supply of the inert gas into the metal melt 3 in the furnace 4 and the transportation of the additive material 5 into the metal melt 3 in the furnace 4 can be operated simultaneously or alternately.

Figure 3:
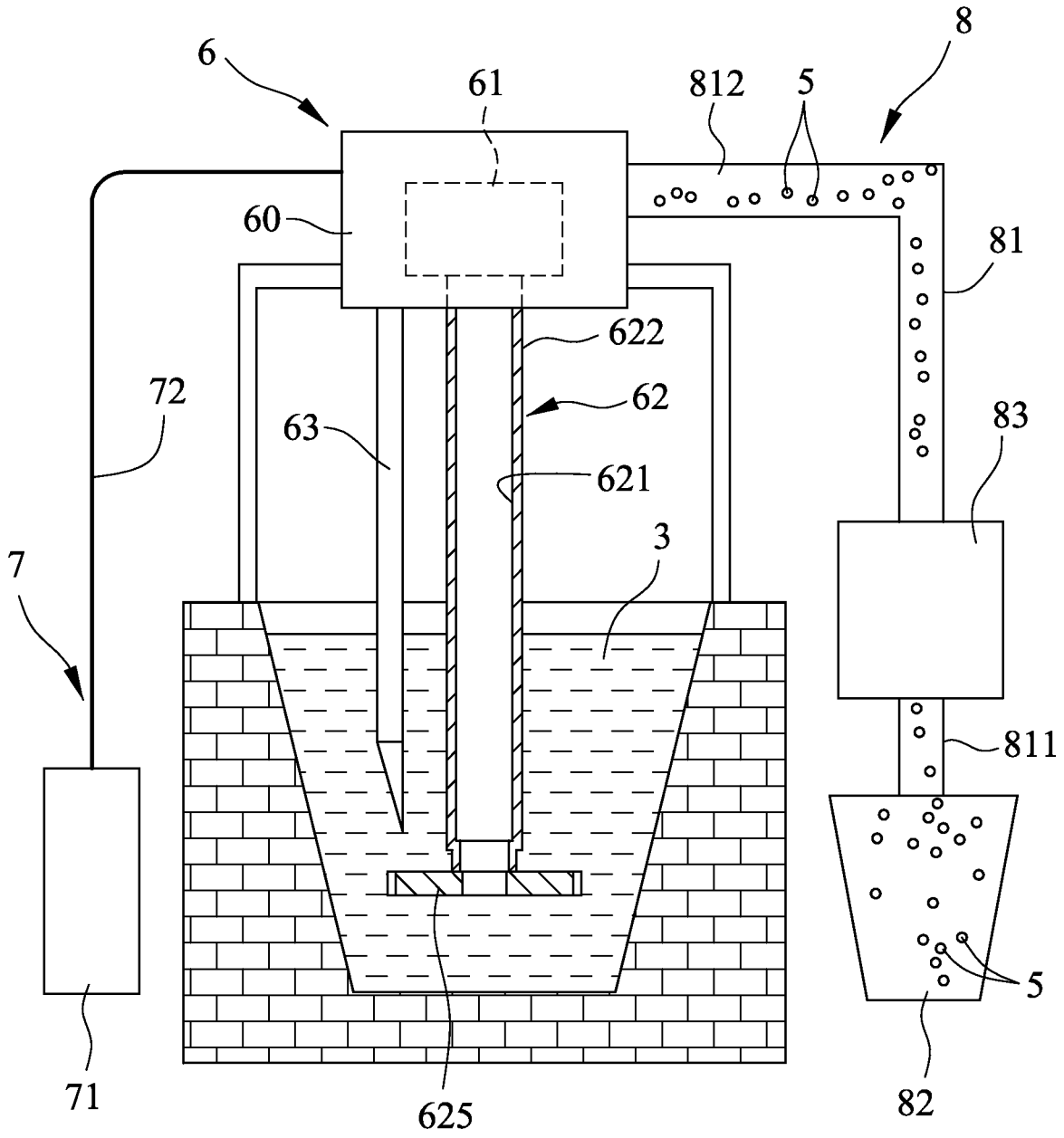
FIG. 3 is a schematic view of a second embodiment of the stirring device according to the disclosure.

Referring to FIG. 3, a second embodiment of a stirring device according to the disclosure is similar to the first embodiment, except that in the second embodiment, the shaft member 62 is configured as the hollow rotary shaft 622 (i.e., not including the sleeve 624).

In addition, the feeding unit 8 further includes a feeding motor 83 that is disposed downstream of the storage tank 82 and upstream of the hollow rotary shaft 622 so as to pump the additive material 5 from the storage tank 82 through the driving mechanism 60 and the hollow rotary shaft 622 into the metal melt 3 in the furnace 4. The feeding tube 81 includes an upstream feeding tube 811 that interconnects the storage tank 82 and the feeding motor 83, and a downstream feeding tube 812 that interconnects the feeding motor 83 and the drive mechanism 60, so as to permit the additive material 5 to be transported from the storage tank 82 into the metal melt 3 in the furnace 4 through the upstream feeding tube 811, the feeding motor 83, the downstream feeding tube 812, the drive mechanism 60, and the hollow rotary shaft 622. The piping member 72 interconnects the gas supply 71 and the drive mechanism 60 so as to permit the inert gas to be transported from the gas supply 71 into the metal melt 3 in the furnace 4 through the piping member 72, the drive mechanism 60, and the hollow rotary shaft 622.

When the second embodiment is operated, the supply of the inert gas into the metal melt 3 in the furnace 4 and the transportation of the additive material 5 into the metal melt 3 in the furnace 4 are operated alternately. For example, the supply of the inert gas into the metal melt 3 in the furnace 4 is implemented for a time period of 10 minutes, and then the transportation of the additive material 5 into the metal melt 3 in the furnace 4 is implemented for a time period of 10 minutes.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but s intended to cover various arrangements included within the spirit and scope of the broadest interpretation so as to encompass all such modifications and equivalent arrangements.

What is claimed is:

1. A stirring device having degassing and feeding functions and adapted to be installed in a furnace that contains a metal melt, the stirring device comprising:

a stirring unit including a drive mechanism, and a shaft member which extends axially into the furnace, and which includes a hollow rotary shaft coupled to be driven by said drive mechanism to rotate and a stirring head coupled to rotate with said hollow rotary shaft;

a gas supplying unit including a gas supply, and a piping member fluidly communicating with said gas supply and said shaft member; and a material feeding unit including a material storage tank, and a material feeding tube fluidly communicating with said material storage tank and said shaft member, wherein said stirring unit further includes a baffle that is fixed to said drive mechanism, and that is spaced apart from said shaft member and extends axially into the furnace.

2. The stirring device according to claim 1, wherein said hollow rotary shaft defines an inner passage that fluidly communicates with said piping member, and wherein said shaft member further includes a sleeve that is sleeved around and spaced apart from said hollow rotary shaft to define an outer passage between said sleeve and said hollow rotary shaft, and that is fixed in place relative to said drive mechanism to permit said hollow rotary shaft to rotate relatively to said sleeve, said outer passage fluidly communicates with said material feeding tube.

3. The stirring device according to claim 1, wherein said material feeding unit further includes a feeding motor disposed downstream of said material storage tank and upstream of said hollow rotary shaft.

4. The stirring device according to claim 2, wherein said gas supply fluidly communicates with said hollow rotary shaft and said material feeding tube, and is selectively controlled to supply inert gas into said hollow rotary shaft and said material feeding tube.

5. The stirring device according to claim 4, wherein said piping member includes a first piping fluidly communicating with said hollow rotary shaft, and a second piping fluidly communicating with said material feeding tube.

6. The stirring device according to claim 1, wherein said drive mechanism includes a rotary motor which is coupled to drive rotation of said hollow rotary shaft.

7. The stirring device according to claim 1, wherein said baffle includes a main board portion extending downwardly from said drive mechanism into the furnace, and a wedge-shaped extending portion extending downwardly and convergingly from said main board portion.

8. The stirring device according to claim 1, wherein said shaft member is made from graphite.

9. The stirring device according to claim 1, wherein said baffle is made from graphite.

* * * * *